US011473280B2

(12) United States Patent
Glivar

(10) Patent No.: US 11,473,280 B2
(45) Date of Patent: Oct. 18, 2022

(54) SELF CLEANING SINK

(71) Applicant: Michael K. Glivar, Colorado Springs, CO (US)

(72) Inventor: Michael K. Glivar, Colorado Springs, CO (US)

( * ) Notice: Subject to any disclaimer, the term of this patent is extended or adjusted under 35 U.S.C. 154(b) by 0 days.

(21) Appl. No.: 16/874,615

(22) Filed: May 14, 2020

(65) Prior Publication Data

US 2020/0362547 A1 Nov. 19, 2020

Related U.S. Application Data

(60) Provisional application No. 62/848,549, filed on May 15, 2019.

(51) Int. Cl.

| | |
|---|---|
| ***E03C 1/048*** | (2006.01) |
| ***B08B 9/00*** | (2006.01) |
| ***E03C 1/182*** | (2006.01) |

(52) U.S. Cl.

CPC ..... *E03C 1/048* (2013.01); *B08B 9/00* (2013.01); *E03C 1/182* (2013.01)

(58) Field of Classification Search

CPC ..... E03C 1/048
USPC ..... 4/653, 650, 671, 675, 679
See application file for complete search history.

(56) References Cited

U.S. PATENT DOCUMENTS

| | | | | |
|---|---|---|---|---|
| 1,014,787 | A | 1/1912 | Torossian | |
| 1,382,992 | A | 6/1921 | Lombard | |
| 1,426,046 | A | 8/1922 | Cohen | |
| 1,677,160 | A | 7/1928 | Woolfenden | |
| 2,762,058 | A | 9/1956 | Bohdan | |
| 2,993,213 | A | 7/1961 | Carroll | |
| 4,295,233 | A | 10/1981 | Hinkel et al. | |
| 5,862,545 | A | 1/1999 | Mathis et al. | |
| 2007/0011806 | A1* | 1/2007 | Knowlton | E03C 1/18 4/619 |
| 2019/0145086 | A1* | 5/2019 | Van Der Jagt | E03C 1/01 4/665 |

* cited by examiner

*Primary Examiner* — Lori L Baker
(74) *Attorney, Agent, or Firm* — Kenneth Altshuler

(57) ABSTRACT

A sink that has a self-cleaning basin generally includes a sink basin that is defined by a sink rim, a sink base drain, a sink basin outer surface, a bowl shaped sink basin inner surface, and a plurality of ramped channels recessed in the inner surface located within one inch from the sink rim. Each of the ramped channels is defined by a deep end that essentially evenly ramps to the inner surface at a ramp terminating end. Each of the ramped channels is angled essentially between 0° and 10° with the ramp terminating end further away from the sink rim than a back channel side that is located at the deep end, so that the channels are hidden in an under-mounted sink. Each channel has an aperture located at the back channel side of each of the ramped channels. Each of the apertures is configured to connect with a water line dispenses water through the aperture along the ramped channel and into the sink basin inner surface where the water swirls to clean the sink basin.

20 Claims, 10 Drawing Sheets

SELF CLEANING SINK

CROSS-REFERENCE TO RELATED APPLICATIONS

This application claims priority to and the benefit of U.S. Provisional Patent Application No. 62/848,549 entitled: Smarter Sink, filed on May 15, 2019.

FIELD OF THE INVENTION

The present embodiments are directed to a self-cleaning sink that produces a swirling stream of water to clean a sink bowl.

DESCRIPTION OF RELATED ART

Present day sinks typically rest on or under a countertop and are fed by hot and cold running water that exits the sink through a drain in the bottom of the sink basin. Sinks are used for washing hands, spitting toothpaste, washing shaving debris from a razor, and general dispensing of water carried debris down the drain. Often, a sink basin is filled with water for face washing. In this instance, a person cups water from the filled sink basin in their hands and pours it on their face with the used water dribbling back into the sink basin. It takes some effort to clean the sink basin from all of the other uses prior to filling water in the sink basin for washing one's face. It is to innovations related to solving at least this problem that the claimed invention is generally directed.

SUMMARY OF THE INVENTION

The present embodiments are directed to a self-cleaning sink that produces a swirling stream of water to clean a sink basin.

Certain embodiments of the present invention contemplate a self-cleaning sink basin comprising: a sink basin that is generally defined by a sink rim, a sink base drain, a sink basin outer surface, and a bowl shaped sink basin inner surface, at least 60% of the sink basin inner surface possesses and elliptical cross-section as viewed from above the self-cleaning basin; and a plurality of ramped channels recessed in the inner surface located within one inch from the sink rim, each of the ramped channels is defined by a deep end that essentially evenly ramps to the inner surface at a ramp terminating end, each of the ramped channels is angled essentially between 0° and 10° with the ramp terminating end further away from the sink rim than a back channel side that is located at the deep end, an aperture located at the back channel side of each of the ramped channels, each of the apertures configured to connect with a water line that provides a stream of water adapted to flow through the aperture along the ramped channel and into the sink basin inner surface where the water swirls in the self-cleaning basin.

Yet other certain embodiments of the present invention contemplate an operational self-cleaning sink method comprising: providing a sink basin that is generally defined by a sink rim, a sink base drain, a sink basin outer surface, a bowl shaped sink basin inner surface, a plurality of ramped channels, the plurality of ramped channels are in a location consisting of being within 1.5 inches from the rim, supplying a stream of water to the plurality of ramped channels via a water outlet aperture in each of the ramped channels, each of the ramped channels defined by a back channel side through which the water outlet aperture penetrates, an elongated ramped portion extending from the back channel side where the ramped channel is deepest to a terminating end that ramps into the sink basin inner surface; flowing the stream of water along the elongated ramped portion and into the sink basin inner surface, the stream of water circulating in a spiral motion in the sink basin inner surface.

While other certain embodiments of the present invention contemplate a self-cleaning sink comprising: a sink basin that is generally defined by a sink rim, a sink base drain, a sink basin outer surface, and a bowl shaped sink basin inner surface; means for supplying a stream of water to the sink basin from a plurality of outlet apertures within 1.5 inches from the sink rim; means for channeling the stream of water from the outlet apertures to the sink basin inner surface; and means for substantially coating the sink basin inner surface with spiraling water.

DETAILED DESCRIPTION

Initially, this disclosure is by way of example only, not by limitation. Thus, although the instrumentalities described herein are for the convenience of explanation, shown and described with respect to exemplary embodiments, it will be appreciated that the principles herein may be applied equally in other types of situations involving similar uses of a self cleaning sink.

Certain embodiments of the present invention generally relate to a self-cleaning sink basin that includes a sink basin that is defined by a sink rim, a sink base drain, a sink basin outer surface, a bowl shaped sink basin inner surface, and a plurality of ramped channels recessed in the inner surface located within one inch from the sink rim. Each of the ramped channels is defined by a deep end that essentially evenly ramps to the inner surface at a ramp terminating end. Each of the ramped channels is angled essentially between 0° and 10° with the ramp terminating end further away from the sink rim than a back channel side that is located at the deep end, so that the channels are hidden in a under-mounted sink. Each channel has an aperture located at the back channel side of each of the ramped channels. Each of the apertures is configured to connect with a water line dispenses water through the aperture along the ramped channel and into the sink basin inner surface where the water swirls and agitates the surface of the sink basin to clean the sink basin.

With respect to the drawings, it is noted that the figures are not to scale and are diagrammatic in nature in a way that is thought to best illustrate features of interest. Descriptive terminology such as, for example, upper/lower, top/bottom, horizontal/vertical, left/right and the like, may be adopted with respect to the various views provided in the figures for purposes of enhancing the reader's understanding and is in no way intended to be limiting. All embodiments described herein are submitted to be operational irrespective of any overall physical orientation. In what follows, similar or identical structures may (and may not) be identified using identical callouts throughout the various figures.

Figure 1:
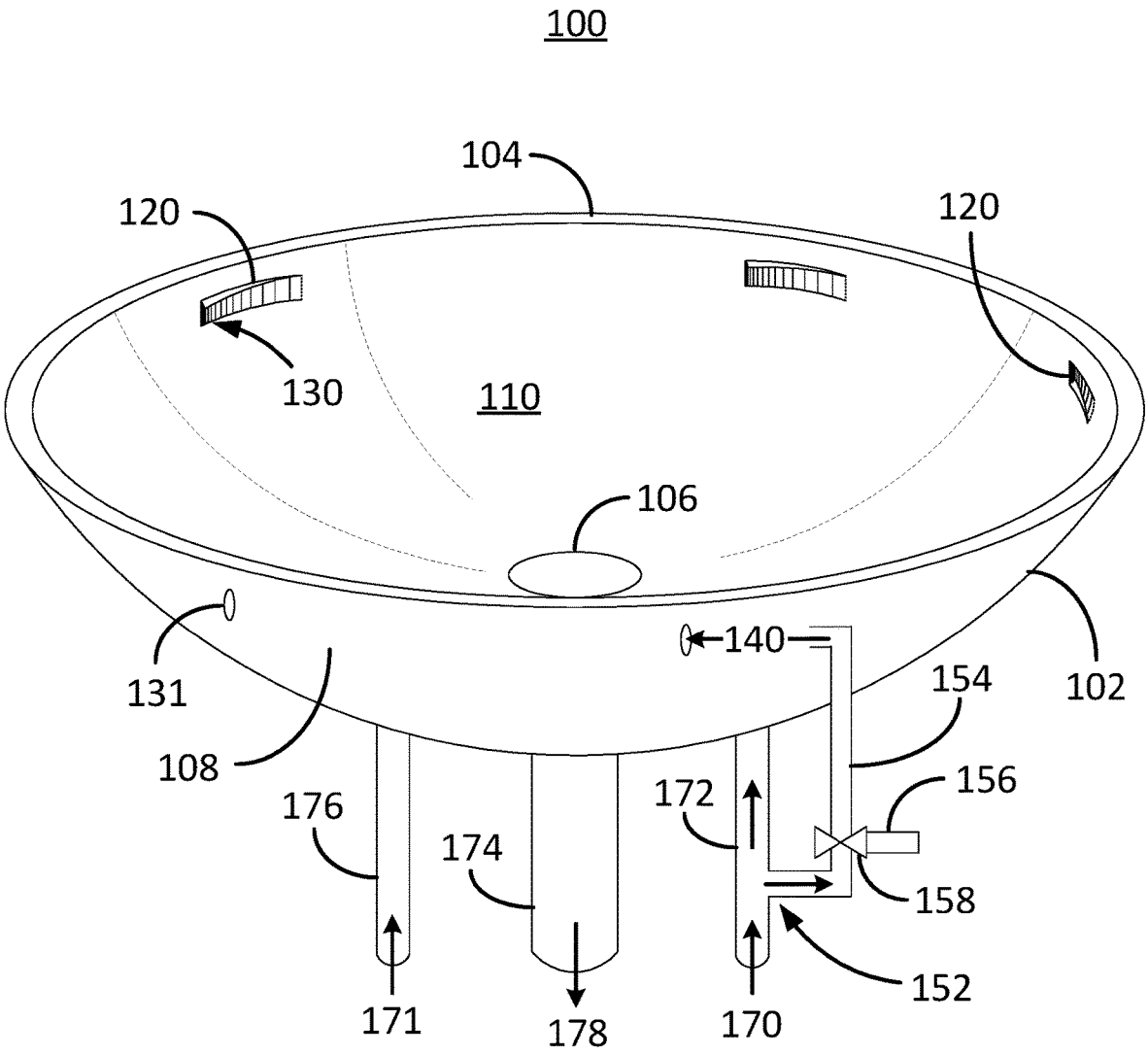
FIG. 1 is a line drawing a perspective view of a self-cleaning sink embodiment consistent with embodiments of the present invention.

FIG. 1 is a line drawing of a perspective view of a self-cleaning sink embodiment consistent with embodiments of the present invention. Some of the general components of the self-cleaning sink embodiment 100 shown for reference include a sink basin 102 that is generally defined by a bowl having a sink rim 104 along the top of the bowl/basin 102 and a sink base drain 106 at the bottom of the bowl/basin 102. The sink base drain 106 is essentially a port that leads to a drainpipe 174 through which water and debris is carried from the sink basin 102 in the direction of the arrow 178. A cold water line 176 supplies cold water 171 to a faucet (not shown). Similarly, a hot water line 172 supplies hot water 170 to the faucet. A water channel supply line 154 is connected to the hot water line 172 via a hot water diverter 152, which in this case is a "T" junction. In this embodiment, an on/off switch 156 controls a water channel supply line valve 158 to be either opened or closed. When opened, the channel supply line valve 158 provides water flow 140 into channel inlet ports 131 located at the exterior surface of the sink basin 108 (also referred to as the "outer surface"). Obviously, when closed, the channel supply line valve 158 blocks all water 170 from moving through the water channel supply line 154. The on/off switch 156 can be an optically actuated electrical switch that actuates 'on' when a person waives their hand in front of an optical sensor (toggling the on/off switch 156 in an on position). Optionally, when toggled 'on', the channel supply line valve 158 can be held open for a predetermined amount of time considered sufficient to clean the sink basin inner surface 110, such as thirty seconds or a minute for example, before shutting off. The predetermined amount of time can be set by a manufacture or optionally an end user and can be accomplished by way of a software valve-closing-delay algorithm running on a microprocessor, a mechanical closing-delay, or an electrical closing-delay, just to name a few examples. Other embodiments of actuating an on/off switch 156 includes, but is not limited to, a manually operated button, a knob, a voice command switch, utility control hub switch (such as, and Amazon Alexa), and timer actuated switch that may go off one or more times every day at a set time.

Recessed in the bowl shaped sink basin inner surface 110 are a plurality of ramped channels 120. Each ramped channel 120 has a channel outlet port 130 located to the far left of the visibly displayed ramp shape channels 120. Each channel outlet port 130 is in communication with a channel inlet port 131. Accordingly, the channel outlet ports 130 dispense water 140 that is received from the channel inlet ports 131 into the sink basin inner surface 110.

Figure 2:
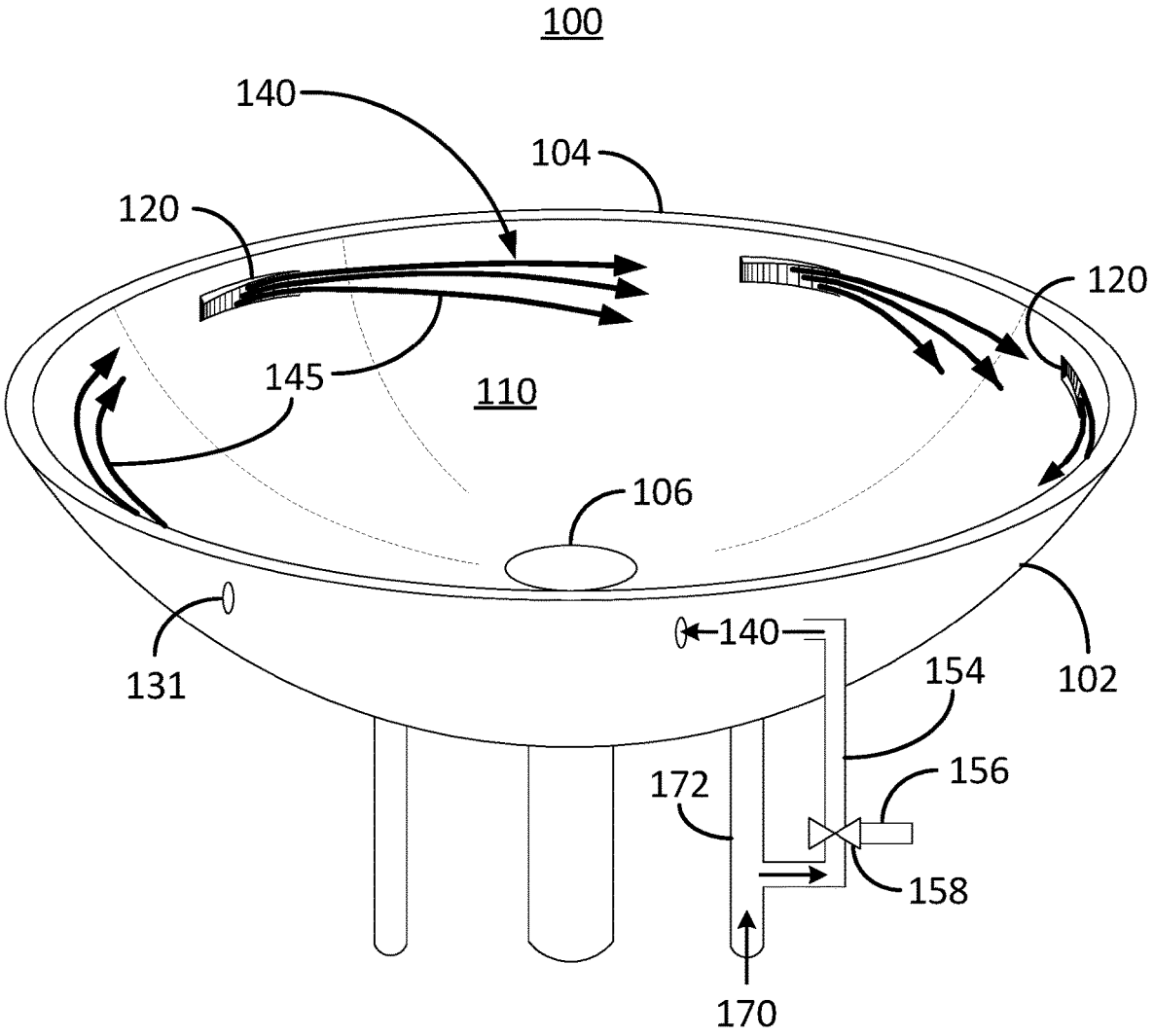
FIG. 2 illustratively depicts water flowing into the sink basin inner surface of a self-cleaning sink embodiment consistent with embodiments of the present invention.

FIG. 2 illustratively depicts water flowing into the sink basin inner surface of a self-cleaning sink embodiment consistent with embodiments of the present invention. When the on/off valve 158 is 'opened', hot water 170 flows through the water channel supply line 154 and into the channel inlet port 130 where the water 140 is dispensed into the sink basin 102. It is envisioned that the hot water stream 140 flows with enough pressure to swirl in the sink basin inner surface 110 towards the sink base drain 106 in a spiral motion 145, as shown. In this way, the swirling hot water 140 cleans the sink basin inner surface 110 from any filth that has accumulated on the inner surface 110 from prior use by agitating, or otherwise scrubbing, the inner surface 110. Gravity pulls the swirling water 140 towards the sink base drain 106 where it exits the sink basin 102. Some embodiments contemplate adding a detergent or some other kind of cleaning solution to the water 140 such as a dispenser tied to the water channel supply line 154 to improve the cleaning. In this embodiment, a small amount of the cleaning solution can be added to the beginning portion of the water released and then followed up with water free from cleaning solution to rinse any cleaning solution from the sink inner surface 110.

Figure 3A:
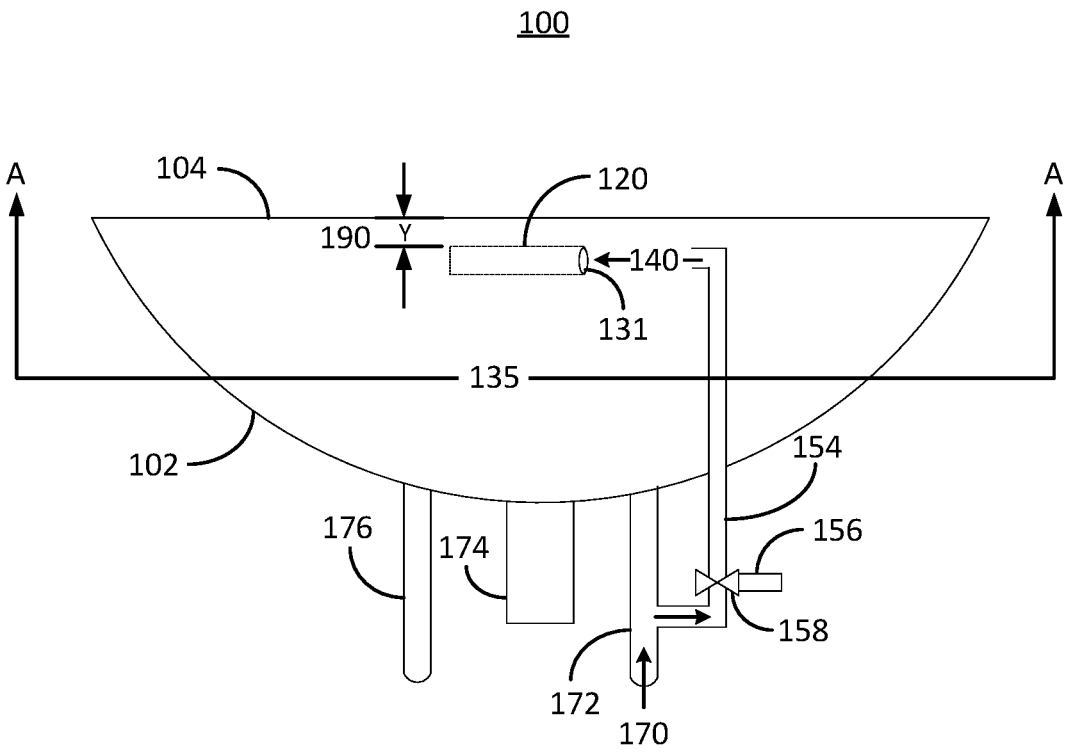
FIGS. 3A-3D show line drawings of optional cross-sectional shapes of a sink basin inner surface consistent with embodiments of the present invention.
Figure 3B:
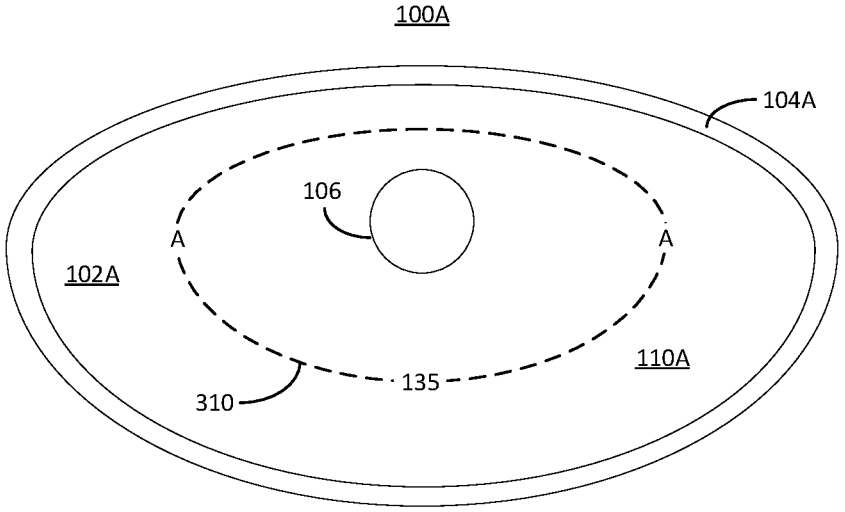
Figure 3C:
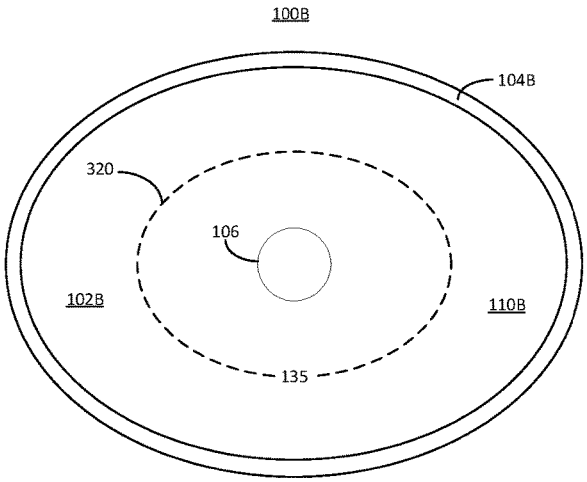
Figure 3D:
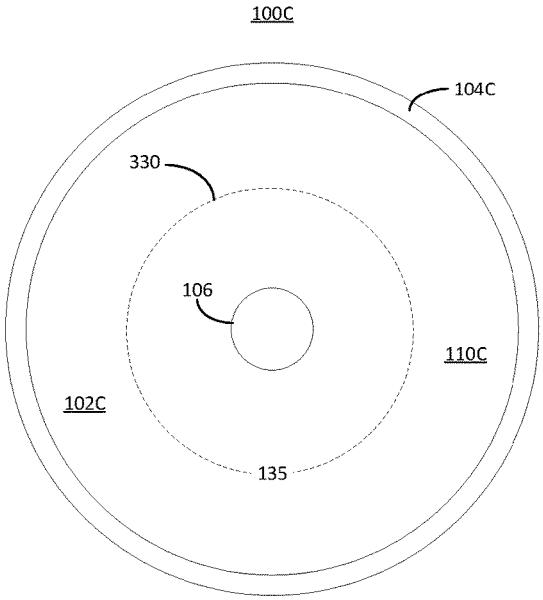

FIGS. 3A-3D show line drawings of optional cross-sectional shapes of a sink basin inner surface consistent with embodiments of the present invention. FIG. 3A is a side view drawing of a self-cleaning basin embodiment with cross-section A-A 135 cutting through the midpoint of the sink basin 102. For reference, each of the ramped channels 120 are located a distance "Y" 190 from the sink rim 104 as shown from this perspective, discussed in more detail in conjunction with FIG. 7. FIG. 3B is a top view line drawing of a sink embodiment 100A showing a partial elliptically shaped sink basin 102A as viewed from above. The cross-section A-A 135, which is shown by way of the dashed line, shows that at least 60% of the sink basin inner surface 110A along cross-section A-A 135 is partially elliptical 310. The other 40% can be a different ellipse, flat, or some other shape. Though the sink rim 104A follows the same partial elliptical shape 310 as the cross-section 135, this can vary without departing from the scope and spirit of the present invention. FIG. 3C is a top view line drawing of a sink embodiment 100B showing a full elliptically shaped sink basin 102B as viewed from above. The cross-section A-A 135, which is shown by way of the dashed line 135 at the inner surface 110B, is fully elliptical 320. Again, the sink rim 104B is not limited to the elliptical shape 320. FIG. 3D is a top view line drawing of a sink embodiment 100C showing a circular shaped sink basin 102C as viewed from above. The cross-section A-A 135, which is shown by way of the dashed line 135 at the inner surface 110C, is a full circle 330. The sink rim 104C is not limited to the circular shape 330.

Figure 4A:
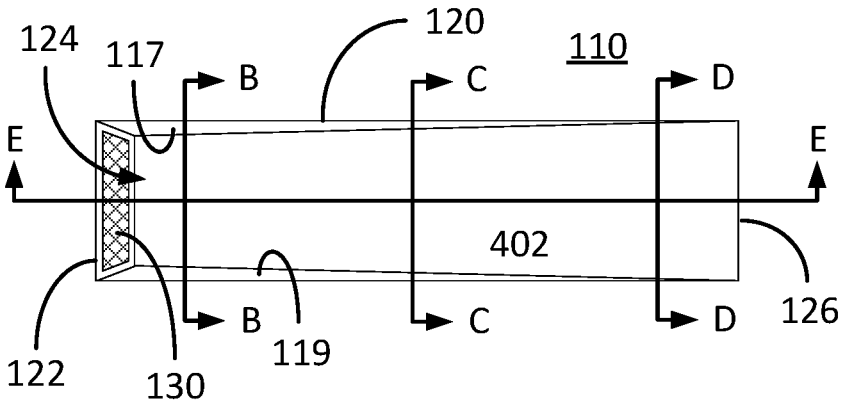
FIGS. 4A-4C are different line drawing views of a ramped channel embodiment consistent with embodiments of the present invention.
Figure 4B:
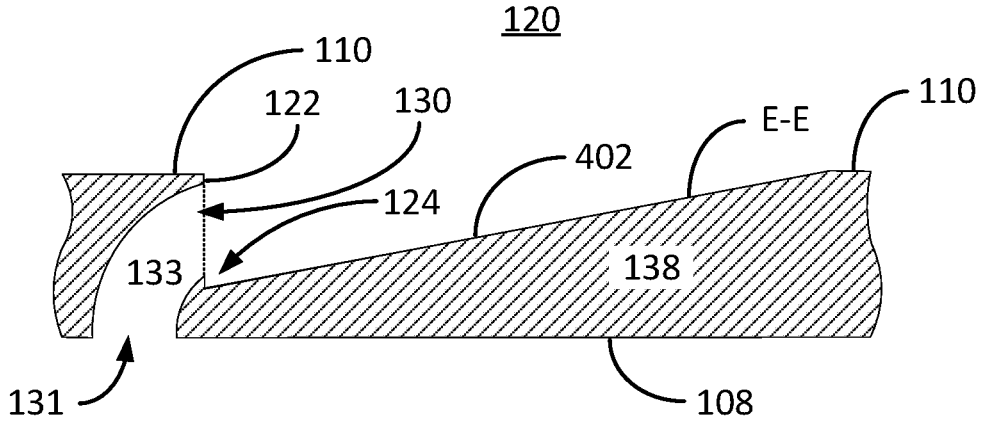
Figure 4C:
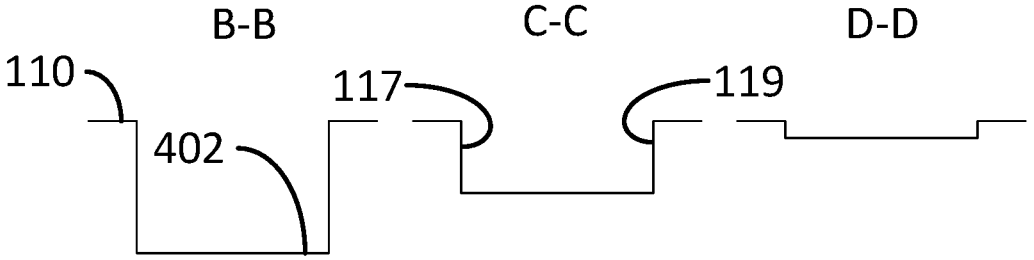

With regards to certain embodiments of a ramped channel, FIGS. 4A-4C are different line drawing views of a ramped channel embodiment consistent with embodiments of the present invention. FIG. 4A is a top view perspective line drawing of a ramped channel embodiment 120 recessed in the sink basin inner surface 110. This ramped channel 120 is defined by a deep end 124 that essentially evenly ramps 402 or otherwise extends to a terminating end 126 at the sink basin inner surface 110. Certain embodiments envision the deep end 124 being less than 0.75 inches deep as defined by the sink basin inner surface 110. While other embodiments envision the deep end 124 being less than 0.5 inches deep. In one embodiment, the deep end 124 is approximately 0.25 inches deep. The outlet aperture 130 is located at the back channel side 122 essentially at the deep end 124. The outlet aperture 130 is rectangular in this embodiment, however the outlet aperture 130 is not limited to any specific shape. The ramped channel 120 is further defined by an upper side wall 117 and a lower side wall 119. The ramped channel 120 is arranged and configured to dispense (or channel) a pressurized stream of water 140 (smoothly without splashing) into the sink basin inner surface 110. Water flow 140 spreads out more efficiently with a ramped configuration. Moreover, water dispensed to the sink basin inner surface 110 by way of the ramped channel control splashing given that the outlet aperture 130 is recessed in the sink basin inner surface 110. A recessed ramped channel 120 also has manufacturing benefits in that a molded sink can be easily made from a single piece of material. For purposes of description, depicted are four cross-section lines B-B, C-C, D-D and E-E.

FIG. 4B shows a side view of the embedded channel along cross-section line E-E. From this point of view, the ramp 402 evenly transitions from the deep end 124 to the sink basin inner surface 110. However, other embodiments envision a non-flat shaped ramp, such as a curved or arced-shaped ramp, for example. The volume of material 138 between the sink basin outer surface 108 and the sink basin inner surface 110 is shown by the shaded regions 138. The sink material 138 is any rigid material suitable to function as a sink, such as ceramic, polymer, metal, composites, just to name several examples. The sink inner volume 138 shows one embodiment of the water passageway 133 defined between the inlet aperture 131 and the outlet aperture 130. Other shaped water passageways 133 can be used without departing from the scope and spirit of the present invention.

FIG. 4C are line drawings showing the cross-sectional shapes of the ramp 402 and the relative lengths of the side walls 117 and 119 along the different cross-sectional cut-lines B-B, C-C and D-D. The ramped channel is considered herein as one means for channeling the stream of water 140 from the outlet apertures 130 to the sink basin inner surface 110.

Figure 5A:
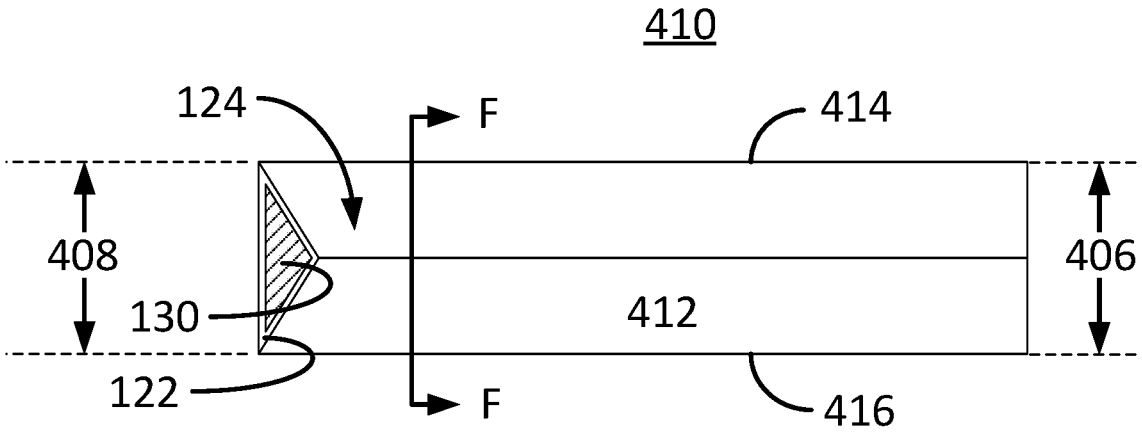
FIGS. 5A-5E are line drawings of optional shaped ramped channels consistent with embodiments of the present invention.
Figure 5B:
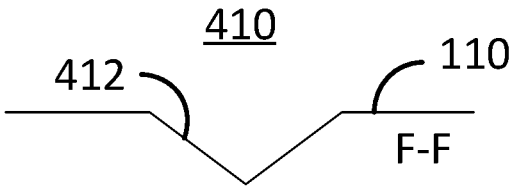
Figure 5C:
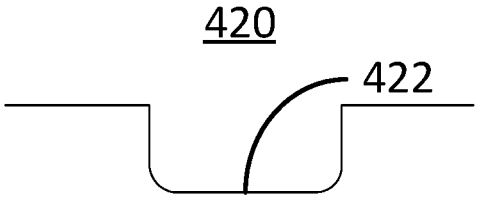
Figure 5D:
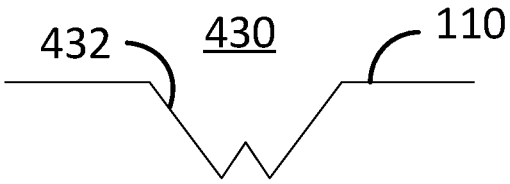
Figure 5E:
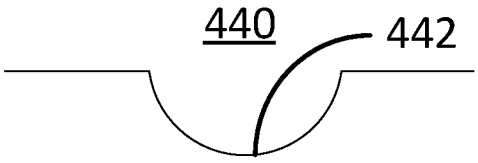

FIGS. 5A-5E are line drawings of optional shaped ramped channels consistent with embodiments of the present invention. The embodiments expressed in FIGS. 5A-5E are also considered different means for channeling the stream of water 140 from the outlet apertures 130 to the sink basin inner surface 110. FIG. 5A shows a V-shaped ramped channel 410 with a V-shaped back side 122 and a V-shaped outlet aperture 130 at the deep end 124 of the V-shaped ramped channel 410. The sidewalls 412 of the V-shaped ramped channel 410 gradually level off as they transition ('feather') into the sink basin inner surface 110. A cross-sectional cut-line F-F is shown sectioning along the V-shaped ramps 412. For illustration purposes, a channel cross-sectional cut-line, such as F-F, is defined as a cut-line taken orthogonally across the top channel edge 414 to a bottom channel edge 416 (which can be considered as universal reference locations herein). FIG. 5B depicts the cross-section along cut-line F-F showing the V-shaped profile sidewalls 412. FIG. 5C depicts the cross-section of an optional embodiment of a U-shaped ramped channel 420 with a U-shaped profile 422. FIG. 5D depicts the cross-section of an optional embodiment of a W-shaped ramped channel 430 with W-shaped sidewalls 432. FIG. 5E shows the cross-section of an optional embodiment of an elliptical-shaped ramped channel 440 with elliptically-shaped profile 442. Though the present embodiments of a channel illustratively depict parallel sidewalls, other embodiments envision the sidewalls not being parallel, such as sidewalls that flare outwards with the terminating end width 404 being wider than the back channel width 408.

Figure 6:
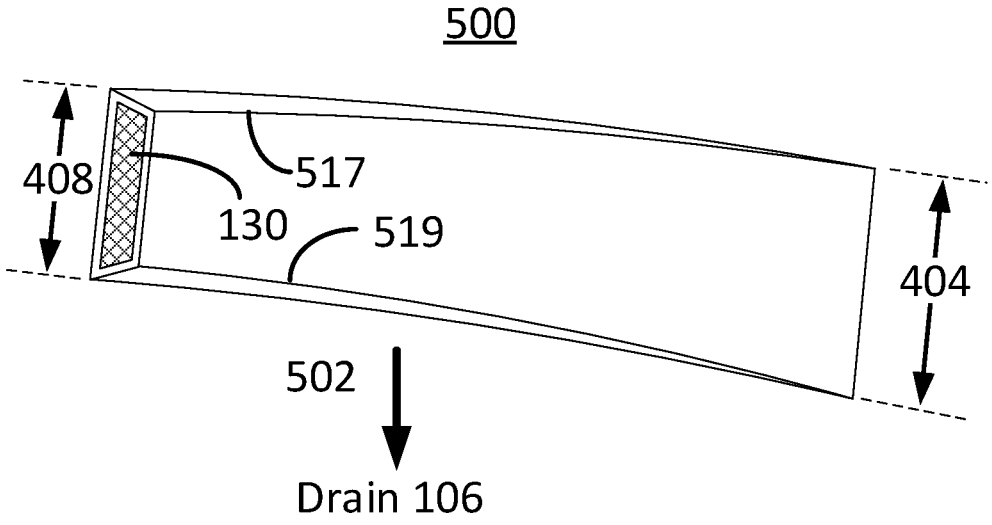
FIG. 6 is a line drawing of yet a different embodiment of a ramped channel consistent with embodiments of the present invention.

FIG. 6 is a line drawing of yet a different embodiment of a ramped channel consistent with embodiments of the present invention. In this embodiment, the ramped channel 500 points slightly towards the sink base drain 106 as indicated by the arrow 502. The sidewalls 517 and 519 are slightly curved/arced towards the drain 106. Additionally, the back channel with 408 is narrower than the terminating end width 404. This embodiment helps direct water 140 that is streamed through the outlet aperture 130 in a downward spiraled motion 145 that spreads the water 140 evenly over the sink basin inner surface 110.

Figure 7:
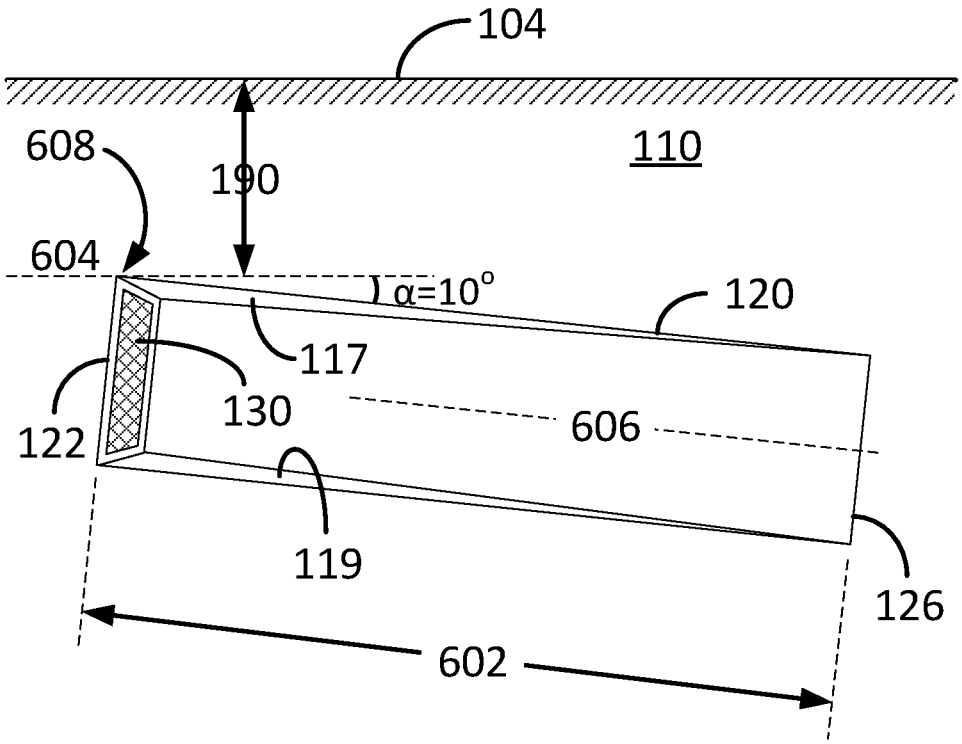
FIG. 7 is a line drawing of the position of a ramped channel embodiment consistent with embodiments of the present invention.

FIG. 7 is a line drawing of the position of a ramped channel embodiment consistent with embodiments of the present invention. As shown, the ramped channel 120 has a tilt angle 'a' at approximately 10° from a horizontal reference line 604 that is parallel to the sink rim 104 with the terminating end 126 pointing towards the sink base drain 106. Some embodiments envision channel tilt angle 'a' of between 0° and 10° with the ramp terminating end 126 further away from the sink rim 104 than the back channel side 122. The channel tilt angle 'a' is defined as the angle between the reference line 604 (which is parallel to the sink rim 104) and the center axis 606 along the channel length 602 at the midpoint between the two channel sides 117 and 119. Certain embodiments envision the channel length 602 being at least one inch long while other embodiments envision the channel length 602 being between 1 inch and 2.5 inches long. Some embodiments contemplate the closest point of the ramped channel 120, which in this case is the upper left corner of the ramped channel 120, having a distance 190 less than 1.5 inches from the rim 104. Other embodiments envision the closest point 608 of the ramped channel 120 being approximately one half an inch from the rim 104 so that when the self-cleaning sink 100 is mounted under a countertop 702 (of FIG. 9), the ramped channels 120 are hidden from view.

Figure 8:
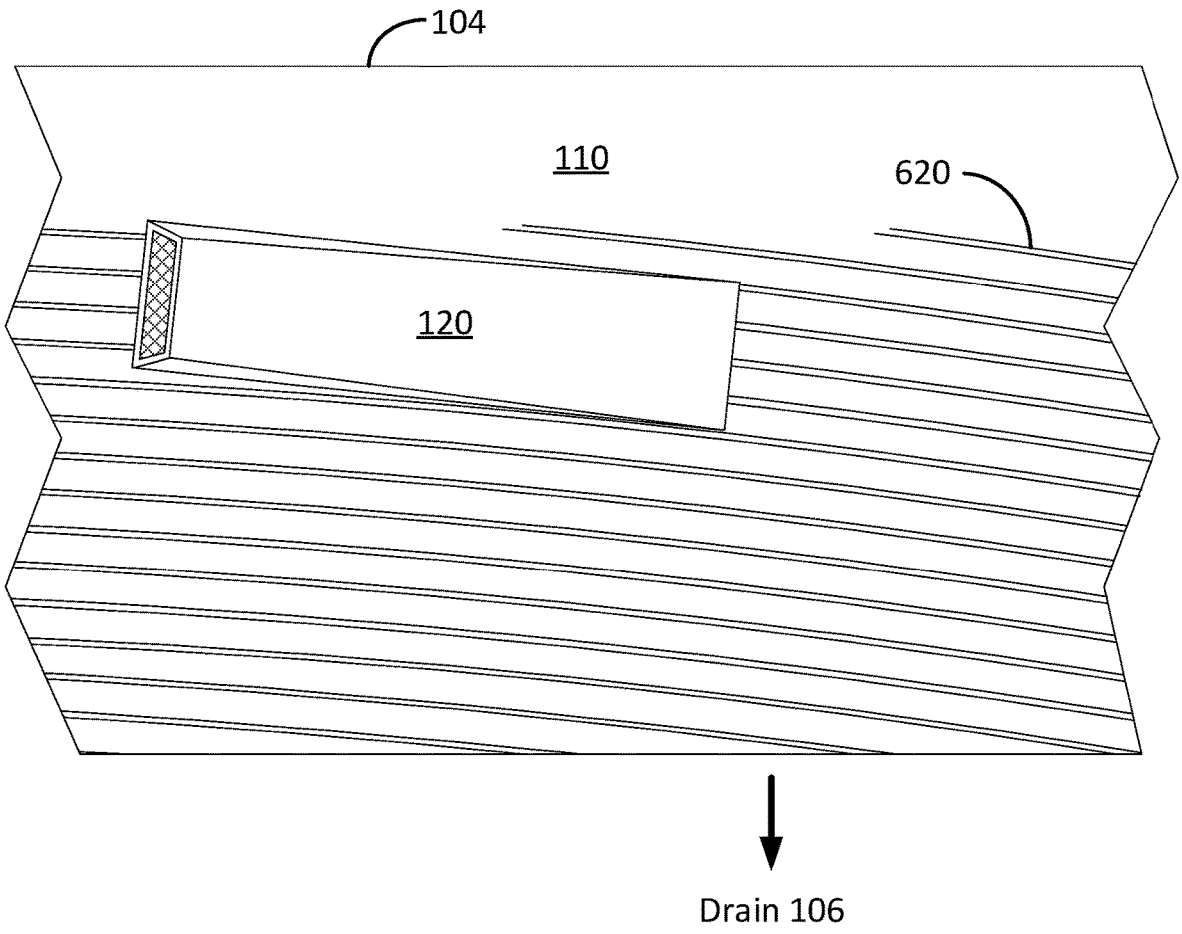
FIG. 8 illustratively depicts a textured sink basin inner surface consistent with embodiments of the present invention.

FIG. 8 illustratively depicts a textured sink basin inner surface consistent with embodiments of the present invention. In this embodiment, the sink basin inner surface 110 is textured to help direct the water 140 in a spiraling direction 145 towards the sink base drain 106. The texture can be a plurality of spiraling grooves 620, which can optionally be ribs, that cover at least a portion of the sink basin inner surface 110 as shown. Hence, water 140 exiting the ramped channel 120 is forced to follow the spiraling grooves 620, or some other texture within the scope and spirit of this embodiment, thereby cleaning the inner surface 110 as the water 140 rushes towards the sink base drain 106. Though not shown, other embodiments envision subtle shapes in the sink basin inner surface 110 that to can direct the water 140 exiting the ramped channel 120 in a spiraling motion 145 that essentially covers the sink basin inner surface 110 to clean the inner surface 110 from residual filth. The embodiments described in conjunction with FIG. 8 are considered means for channeling the stream of water 140 from the outlet apertures 130 to the sink basin inner surface 110.

Figure 9:
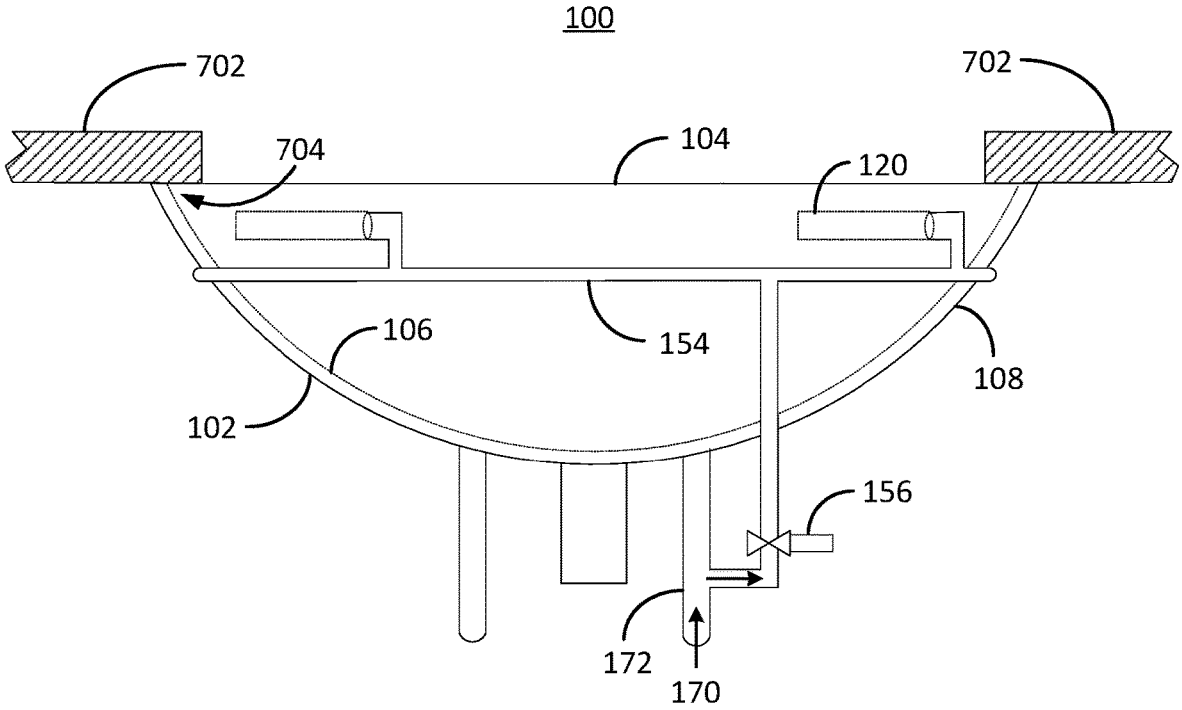
FIG. 9 illustratively depicts a side view of an under mounted self-cleaning sink embodiment consistent with embodiments of the present invention.

FIG. 9 illustratively depicts a side view of an under mounted self-cleaning sink embodiment consistent with embodiments of the present invention. As shown, the countertops 702 comprise an overlapping portion 704 that overlaps the top part of the self-cleaning sink 100 when the sink is under mounted. In this way, the ramped channels 120 are hidden from view so that when water 140 is dispensed from the ramped channels 120 it appears that the water where 40 is magically coming out from under the countertop 702 at the overlapping portion 704. The water channel supply line 154 is one means for supplying a stream of water 140 to the sink basin 102, shown herein as a continuous line around the sink basin outer surface 108.

Figure 10:
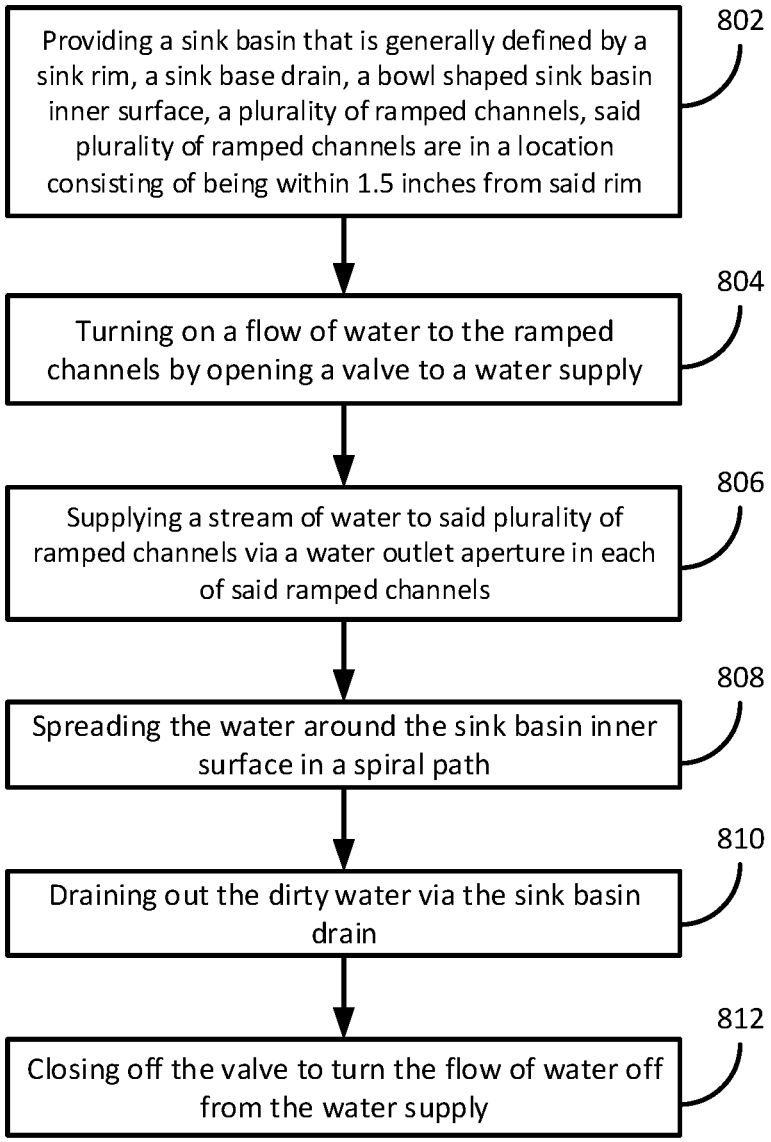
FIG. 10 shows a block diagram of a method to operate a self-cleaning sink consistent with embodiments of the present invention.

FIG. 10 shows a block diagram of a method to operate a self-cleaning sink consistent with embodiments of the present invention. To begin with, step 802, a sink basin 102 is provided which is generally defined by a sink rim 104, a sink base drain 106, a bowl shaped sink basin inner surface 110 and a plurality of ramped channels 120. The plurality of ramped channels are in a location, which in some embodiments consist of being within 1.5 inches from the rim 104. When a person wants to clean the sink basin inner surface 110, a valve 158 to a water supply 170 is opened, step 804, which provides a stream of water 140 to the exit apertures 130 in each of the ramped channels 120, step 806. The water 140 is dispensed in the sink basin 102 in a way that spirals 145 to essentially cover the sink basin inner surface 110, step 808. Certain embodiments imagine the water 140 being dispensed in the sink basin 102 at or below the ramped channels 120 whereby the region of the sink basin inner surface 110 between the sink rim 104 and the ramped channel closest point 608 is not covered with water 140. Draining the water 140 that has cleaned the sink basin inner surface 110 via the sink base drain 106, step 810. Finally, closing off the valve 158 to the water supply 170, which in certain embodiments is after a predetermined amount of time, step 812.

With the present description in mind, below are a summary of some embodiments consistent with the present invention. The elements called out below are examples provided to assist in the understanding of the present invention and should not be considered limiting.

One embodiment envisions a self-cleaning sink basin 100 comprising: a sink basin 102 that is generally defined by a sink rim 104, a sink base drain 106, a sink basin outer surface 108, and a bowl shaped sink basin inner surface 110, at least 60% of the sink basin inner surface 110 possesses and elliptical cross-section 135 as viewed from above the self-cleaning basin 100; and a plurality of ramped channels 120 recessed in the inner surface 110 of the sink basin 102 located within one inch from the sink rim 104, each of the ramped channels 120 is defined by a deep end 124 that essentially evenly ramps to the inner surface 110 at a ramp terminating end 126, each of the ramped channels 120 is angled essentially between 0° and 10° with the ramp terminating end 126 further away from the sink rim 104 than a back channel side 122 that is located at the deep end 124, an aperture 130 located at the back channel side 122 of each of the ramped channels 120, each of the apertures 130 configured to connect with a water line 132 that provides a stream of water 140 adapted to flow through the aperture 130 along the ramped channel 120 and into the sink basin inner surface 110 where the water 140 swirls in the self-cleaning basing 100.

The self-cleaning basin 100 embodiment further considering wherein the elliptical cross-section 135 is essentially circular 330.

The self-cleaning basin 100 embodiment further contemplating wherein the self-cleaning basin 100 is an under mounted sink. This can further include wherein the plurality of ramped channels 120 are essentially hidden from view when attached under a counter 702.

The self-cleaning basin 100 embodiment further comprising water channeling grooves 602 in the sink basin inner surface 110, the water channeling grooves 620 that spiral toward the sink base drain 106.

The self-cleaning basin 100 embodiment further imagining wherein each of the plurality of ramped channels 120 possess a flat base ramp 402 and two side walls 117 and 119, the flat base ramp 402 and the two sidewalls 117 and 119 extend from the back channel side 122 to the ramp terminating end 126.

The self-cleaning basin 100 embodiment further envisioning wherein each of the plurality of ramped channels 120 comprise a channel cross-sectional shape defined orthogonally across a top channel edge 414 to a bottom channel edge 416, the channel cross-sectional shape is selected from a group consisting of a partial ellipse 440, a V-shape 410, a three sides of a rectangle 120, a W-shape 430, and a U-shape 420.

The self-cleaning basin 100 embodiment further comprising a switch 156 that turns the stream of water 140 on and off. This embodiment can further include wherein the switch 156 is selected from a group consisting of an optical switch, a manually actuating switch, a voice command responsive switch, a utility control hub switch, and a timer actuated switch. Optionally, the switch 156 can be configured with a timer that turned the stream of water 140 on for predetermined amount of time.

In yet another arrangements, certain embodiments contemplate an operational self-cleaning sink 100 method comprising: providing a sink basin 102 that is generally defined by a sink rim 104, a sink base drain 106, a sink basin outer surface 108, a bowl shaped sink basin inner surface 110, a plurality of ramped channels 120, the plurality of ramped channels are in a location consisting of being within 1.5 inches from the rim 104, supplying a stream of water 140 to the plurality of ramped channels 120 via a water outlet aperture 130 in each of the ramped channels 120, each of the ramped channels 120 defined by a back channel side 122 through which the water outlet aperture 130 penetrates, an elongated ramped portion 402 extending from the back channel side 122 where the ramped channel 120 is deepest 124 to a terminating end 126 that ramps into the sink basin inner surface 110; flowing the stream of water 140 along the elongated ramped portion 402 and into the sink basin inner surface 110, the stream of water 140 circulating in a spiral motion 145 in the sink basin inner surface 110.

The operational self-cleaning sink 100 method embodiment further comprising essentially coating the entire sink basin inner surface 110 with the stream of water 140 that is circulating in the spiral motion 145 toward the sink base drain 106.

The operational self-cleaning sink 100 method embodiment further contemplating wherein at least 60% of the sink basin inner surface 110 comprises an elliptical cross-section 135 or a circular cross-section 330 that is at least 60% of the sink basin inner surface 110, the elliptical cross-section 320 is defined as that which is viewed from above the self-cleaning sink 100.

The operational self-cleaning sink 100 method embodiment further envisioning wherein the plurality of ramped channels 120 are recesses in the sink basin inner surface 110 that are at least one inch long 602.

The operational self-cleaning sink 100 method embodiment further considering wherein the plurality of ramped channels 120 are arced toward the sink base drain 106.

The operational self-cleaning sink 100 method embodiment further comprising directing the stream of water 140 along spiraled features 620 in the sink basin inner surface 110 toward the sink base drain 106.

The operational self-cleaning sink 100 method embodiment further imagining wherein each of the plurality of ramped channels 120 possess a flat ramp 402 and two side walls 117 and 119, the flat ramp 402 and the two sidewalls 117 and 119 extend from the back channel side 122 to the ramp terminating end 126.

The operational self-cleaning sink 100 method embodiment further contemplating wherein each of the plurality of ramped channels 120 comprise a channel cross-sectional shape defined orthogonally across a top channel edge 414 to a bottom channel edge 416, the channel cross-sectional shape is selected from a group consisting of a partial ellipse 440, a V-shape 410, a three sides of a rectangle 120, a W-shape 430, and a U-shape 420.

The operational self-cleaning sink 100 method embodiment further comprising turning on the stream of water 140 for a preselected amount of time via a switch 156 that turns the stream of water 140 on and off.

The above embodiments are not intended to be limiting to the scope of the invention whatsoever because many more embodiments are easily conceived within the teachings and scope of the instant specification. Moreover, the corresponding elements in the above example should not be considered limiting.

It is to be understood that even though numerous characteristics and advantages of various embodiments of the present invention have been set forth in the foregoing description, together with the details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed. For example, though the embodiments generally refer to ramped channels as a constant shape along the channel, however a combination of cross-sectional shapes could equally be used while still maintaining substantially the same functionality without departing from the scope and spirit of the present invention. Other embodiments envision circular or semi-circular basin bowls, however different shaped bowls with angled shapes albeit with rounded edges would be advantageous to reduce splashing, could be used while staying within the scope of the present invention. Yet other embodiments envision different sized channels in the same basin while maintaining consistency within the scope and spirit of the present invention. Further, the terms "one" is synonymous with "a", which may be a first of a plurality.

It will be clear that the present invention is well adapted to attain the ends and advantages mentioned as well as those inherent therein. While presently preferred embodiments have been described for purposes of this disclosure, numerous changes may be made which readily suggest themselves to those skilled in the art and which are encompassed in the spirit of the invention disclosed and as defined in the claims.

What is claimed is:

1. A self-cleaning sink basin comprising:

a sink basin that is generally defined by a sink rim, a sink base drain, a sink basin outer surface, and a bowl shaped sink basin inner surface, at least 60% of the sink basin inner surface possesses and elliptical cross-section as viewed from above the self-cleaning basin; and a plurality of ramped channels recessed in the inner surface located within one inch from the sink rim, each of the ramped channels is defined by a deep end that essentially evenly ramps to the inner surface at a ramp terminating end, each of the ramped channels is angled essentially between 0° and 10° with the ramp terminating end further away from the sink rim than a back channel side that is located at the deep end, an aperture located at the back channel side of each of the ramped channels, each of the apertures configured to connect with a water line that provides a stream of water adapted to flow through the aperture along the ramped channel and into the sink basin inner surface where the water swirls in the self-cleaning basin.

2. The self-cleaning basin of claim 1 wherein the elliptical cross-section is essentially circular.

3. The self-cleaning basin of claim 1 wherein the self-cleaning basin is an under mounted sink.

4. The self-cleaning basin of claim 3 wherein the plurality of ramped channels are essentially hidden from view when attached under a counter.

5. The self-cleaning basin of claim 1 further comprising water channeling grooves in the sink basin inner surface, the water channeling grooves that spiral toward the sink base drain.

6. The self-cleaning basin of claim 1 wherein each of the plurality of ramped channels possess a flat base ramp and two side walls, the flat base ramp and the two side walls extend from the back channel side to the ramp terminating end.

7. The self-cleaning basin of claim 1 wherein each of the plurality of ramped channels comprise a channel cross-sectional shape defined orthogonally across a top channel edge to a bottom channel edge, the channel cross-sectional shape is selected from a group consisting of a partial ellipse, a V-shape, a three sides of a rectangle, a W-shape, and a U-shape.

8. The self-cleaning basin of claim 1 further comprising a switch that turns the stream of water on and off.

9. The self-cleaning basin of claim 8 wherein the switch is selected from a group consisting of an optical switch, a manually actuating switch, a voice command responsive switch, a utility control hub switch, and a timer actuated switch.

10. The self-cleaning basin of claim 8 wherein the switch is configured with a timer that turned the stream of water on for predetermined amount of time.

11. An operational self-cleaning sink method comprising:

providing a sink basin that is generally defined by a sink rim, a sink base drain, a sink basin outer surface, a bowl shaped sink basin inner surface, a plurality of ramped channels, the plurality of ramped channels are in a location consisting of being within 1.5 inches from the rim, supplying a stream of water to the plurality of ramped channels via a water outlet aperture in each of the ramped channels, each of the ramped channels defined by a back channel side through which the water outlet aperture penetrates, an elongated ramped portion extending from the back channel side where the ramped channel is deepest to a terminating end that ramps into the sink basin inner surface;

flowing the stream of water along the elongated ramped portion and into the sink basin inner surface, the stream of water circulating in a spiral motion in the sink basin inner surface.

12. The operational self-cleaning sink method of claim 11 further comprising essentially coating the entire sink basin inner surface with the stream of water that is circulating in the spiral motion toward the sink base drain.

13. The operational self-cleaning sink method of claim 11 wherein at least 60% of the sink basin inner surface comprises an elliptical cross-section or a circular cross-section that is at least 60% of the sink basin inner surface, the elliptical cross-section is defined as that which is viewed from above the self-cleaning sink.

14. The operational self-cleaning sink method of claim 11 wherein the plurality of ramped channels are recesses in the sink basin inner surface that are at least one inch long.

15. The operational self-cleaning sink method of claim 14 wherein the plurality of ramped channels are arced toward the sink base drain.

16. The operational self-cleaning sink method of claim 11 further comprising directing the stream of water along spiraled features in the sink basin inner surface toward the sink base drain.

17. The operational self-cleaning sink method of claim 11 wherein each of the plurality of ramped channels possess a flat ramp and two side walls, the flat ramp and the two sidewalls extend from the back channel side to the ramp terminating end.

18. The operational self-cleaning sink method of claim 11 wherein each of the plurality of ramped channels comprise a channel cross-sectional shape defined orthogonally across a top channel edge to a bottom channel edge, the channel cross-sectional shape is selected from a group consisting of a partial ellipse, a V-shape, a three sides of a rectangle, a W-shape, and a U-shape.

19. The operational self-cleaning sink method of claim 11 further comprising turning on the stream of water for a preselected amount of time via a switch that turns the stream of water on and off.

20. A self-cleaning sink comprising:

a sink basin that is generally defined by a sink rim, a sink base drain, a sink basin outer surface, and a bowl shaped sink basin inner surface;

means for supplying a stream of water to the sink basin from a plurality of outlet apertures within 1.5 inches from the sink rim;

means for channeling the stream of water from the outlet apertures to the sink basin inner surface; and means for substantially coating the sink basin inner surface with spiraling water.

* * * * *